US005137064A

United States Patent [19]

McGarvey et al.

[11] Patent Number: 5,137,064

[45] Date of Patent: * Aug. 11, 1992

[54] SAFETY TANK APPARATUS FOR LIQUID STORAGE

[75] Inventors: David C. McGarvey, San Gabriel; David C. Whitman, Victorville, both of Calif.

[73] Assignee: LRS, Inc., South El Monte, Calif.

[ * ] Notice: The portion of the term of this patent subsequent to Apr. 9, 2008 has been disclaimed.

[21] Appl. No.: 681,003

[22] Filed: Apr. 5, 1991

Related U.S. Application Data

[60] Continuation of Ser. No. 562,820, Aug. 6, 1990, Pat. No. 5,005,615, which is a division of Ser. No. 462,634, Jan. 8, 1990, Pat. No. 5,016,689.

[51] Int. Cl.[5] ..... B67C 3/00

[52] U.S. Cl. ..... 141/198; 141/98; 141/86; 141/95; 141/206; 220/469; 137/312; 137/429; 417/9; 417/41

[58] Field of Search ..... 141/97, 98, 95, 86, 141/88, 192, 198, 206, 217, 220, 227, 228, 229; 220/469, 85.5, 565, 400; 137/312, 376, 427, 429; 417/9, 41

[56] References Cited

U.S. PATENT DOCUMENTS

| | | |
|---|---|---|
| 1,114,019 | 10/1914 | Morris . |
| 1,273,195 | 7/1918 | Snyder . |
| 1,625,765 | 4/1927 | Ratzenstein . |
| 2,102,912 | 12/1937 | Pittman . |
| 2,558,694 | 6/1951 | Speig . |
| 2,623,362 | 12/1952 | Zerbe . |
| 2,835,270 | 5/1958 | York et al. . |
| 2,858,136 | 10/1958 | Rind . |
| 2,860,807 | 11/1958 | Morton . |
| 2,864,527 | 12/1958 | Altman et al. . |
| 2,869,751 | 1/1959 | Klope et al. . |
| 3,595,424 | 7/1971 | Jackson . |
| 3,605,782 | 9/1971 | Hollis et al. . |
| 3,666,132 | 5/1972 | Yamamoto et al. . |
| 3,702,592 | 11/1972 | Gamble . |
| 3,732,902 | 5/1973 | Muller . |
| 3,827,455 | 8/1974 | Lee . |
| 3,941,272 | 3/1976 | McLaughlin . |
| 3,952,907 | 4/1976 | Ogden . |
| 3,967,256 | 6/1976 | Galatis . |
| 3,969,563 | 7/1976 | Hollis, Sr. . |
| 4,161,957 | 7/1979 | Schoellkopf . |
| 4,281,692 | 8/1981 | Caccamisi . |
| 4,376,489 | 3/1983 | Clemens . |

(List continued on next page.)

FOREIGN PATENT DOCUMENTS 2209183 5/1989 United Kingdom .

OTHER PUBLICATIONS

Ref. 1—Uniform Fire Code, 1985 Ed., pp. 203–278.

(List continued on next page.)

*Primary Examiner*—Ernest G. Cusick
*Attorney, Agent, or Firm*—William W. Haefliger

[57] ABSTRACT

Safety tank apparatus for installation to receive and store a liquid hydrocarbon or hydrocarbons, or the like, and from which liquid may be withdrawn, including: tank structure including an inner metallic tank, and an outer metallic tank protectively receiving the inner tank, the outer tank having a side wall, there being upper interior space above the inner tank and within the tank structure; the tank structure including a cover extending over the interior space; an opening in the sidewall, and a closure closing the opening, the closure movable to expose the upper interior space to access from the exterior; and control structure below the cover, and accessible through the opening for controlling flow of the liquid into the inner tank from the exterior of the safety apparatus; the closure extending above the level of liquid in the inner tank.

21 Claims, 11 Drawing Sheets

U.S. PATENT DOCUMENTS

| | | | |
|---|---|---|---|
| 4,478,345 | 10/1984 | Edinger . | |
| 4,651,893 | 3/1987 | Mooney . | |
| 4,685,327 | 8/1987 | Sharp . | |
| 4,697,618 | 10/1987 | Youtt et al. . | |
| 4,815,621 | 3/1989 | Bartis . | |
| 4,826,644 | 5/1989 | Lindquist et al. . | |
| 4,844,287 | 7/1989 | Long . | |
| 4,890,983 | 1/1990 | Solomon et al. . | |
| 4,911,320 | 3/1990 | McGouran, Jr. . | |
| 4,934,553 | 6/1990 | McCarthy . | |
| 4,948,010 | 8/1990 | Wiggins . | |
| 4,989,750 | 2/1991 | McGarvey . | |
| 5,005,615 | 4/1991 | McGarvey et al. | 141/198 |
| 5,016,689 | 5/1991 | McGarvey et al. | 141/198 |

OTHER PUBLICATIONS

Ref. 2—Reliance Tank Sales Materials (undated)—price list date Jan. 20, 1989.

Ref. 3—Agape Tank Sales materials (dated by postmark Jun. 7, 1989).

Ref. 4—Doehrman, Inc.—facsimile dated May 9, 1989.

Ref. 5—Safe-T-Tank Corp. sales materials dated 1987—Sales materials from Air Boy (Jun. 1988)—advertisement dated Feb. 1987 from Keesee, "Lube Cube" sales materials dated Jul. 1, 1988.

Ref. 6—UL 142 Standard for Safety, Steel Aboveground Tanks (1987).

Ref. 7—Husky 1030 Double Diaphragm Pump (1987) instructions and parts list.

Ref. 8—"Oil Evacuation System", Aro Corp., (1982).

Ref. 9—"½" Waste Oil Evacuation System (drawing dated Mar. 15, 1987).

Ref. 10—"Aro Air Operated Diaphragm Pumps", (1986).

Ref. 11—"Aro Lubrication Equipment" (1989), pp. 31 and 33.

Ref. 12—Cla-Val Co. float control parts list (1977).

"Underwriters Laboratory Listed Tank", Air Boy Sales & Manufacturing Company.

International Search Report PCT/US90/01654, Mar. 28, 1990.

27
30
23
3
24
52
48
40
53
31
54a
58
49
26
71
45
45
46
44
22e
47
22
66
60c
64
10
11
12
60
3
43
70a
42b'
20
21
19
42c
35
36
14
15
14
17
16
18
17

SAFETY TANK APPARATUS FOR LIQUID STORAGE

This is a continuation of application Ser. No. 562,820, filed Aug. 6, 1990 now U.S. Pat. No. 5,005,615 which is a division of 07/462,634, filed Jan. 8, 1990 now U.S. Pat. No. 5,016,689.

BACKGROUND OF THE INVENTION

This invention relates generally to containment or storage of waste oil and other fluids, particularly hydrocarbons; and ;more particularly, to a simple, efficient, easily shipped, and operable containment system, wherein critical components are protected, yet easily accessed and operated.

There is great and continuing need for environmentally safe, easily shipped, and readily installable and usable containment systems for waste oil (for example engine crankcase oil) as well as other liquids and contaminants. Such system should also be fireproof insofar as possible. I am not aware of any presently available system meeting this need, or having the usual advantages in construction, modes of operation and results, as afforded by the present invention.

SUMMARY OF THE INVENTION

It is a major object of the invention to provide an improved system meeting the above need, as well as providing additional advantages in construction and mode of operation. Basically, the safety tank or system of the invention comprises:

a) tank structure including an inner metallic tank, and an outer metallic tank protectively receiving the inner tank, the outer tank having a side wall, there being upper interior space above the inner tank and within the tank structure, b) the tank structure including a cover extending over the inner and outer tanks, c) an opening in the sidewall, and a closure closing the opening, the closure movable to expose the upper interior space to access from the exterior, d) and control means below the cover, and accessible through the opening for controlling flow of the liquid into the inner tank from the exterior of the safety apparatus.

As will appear, the inner tank is enclosed, and when the cover is located on the outer tank and its side wall closure is closed, weather is excluded form the upper interior space below the cover, and above the inner tank, so that the control means is protected, as well as space between the side walls of the inner and outer tanks, and space below the inner tank. That space may be vented. Enhanced fire protection is also thereby provided, the outer tank also offering protection, as from contaminant liquid leakage to the exterior of the inner tank. Such leakage might for example occur due to inadvertent handling of the hose or line connection to a liquid pump, or handling of other closures for bungs in the top cover of the inner tank.

It is a further object of the invention to provide for access to pump means having a liquid intake port and a delivery port, the delivery port communicating with the interior of the inner tank, and a pneumatic fluid control valve connected with the pump drive for controlling vacuum drive fluid flow to the pump drive. The valve has associated means for sensing the level of liquid in the inner tank, and for closing the valve in response to rising of the liquid surface to a predetermined level. Also, an audible alarm may then be activated. In this regard, the closed inner tank typically has an upper or top wall that supports the pump and valve to be directly accessible via the opening in the closure side wall.

Another object includes provision of means to control inflow of liquid into the inner tank in response to liquid level changes in the inner tank and also within a safety space surrounding the inner tank.

Additional objects include the provision of a first aperture in the inner tank upper wall, via which liquid in the tank may be removed by a duct extending below the inner tank top wall; the provision of a second aperture in the inner tank top wall for venting air from the inner tank as liquid is filled into the inner tank by operation of the pump. These elements, as well as others, are easily accessed when the closure or door in the side wall of the top closure is opened. Multiple tank combinations may also be provided.

These and other objects and advantages of the invention, as well as the details of an illustrative embodiment, will be more fully understood from the following specification and drawings, in which:

DRAWING DESCRIPTION

DETAILED DESCRIPTION

Figure 1:
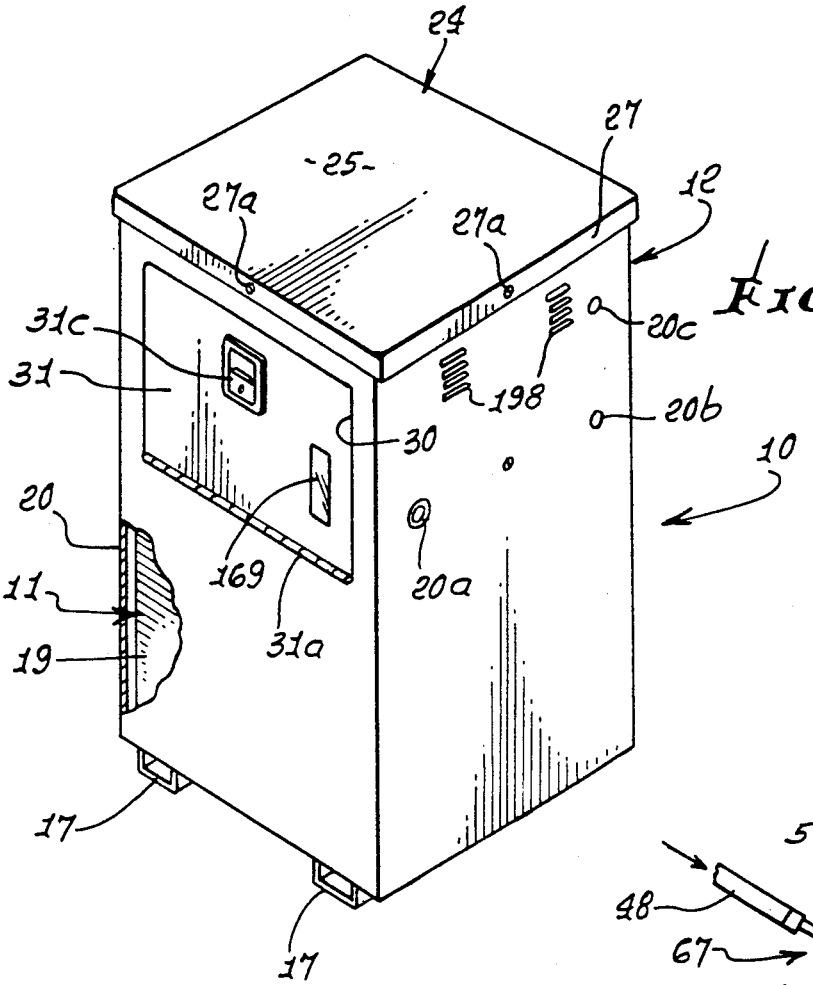
FIG. 1 is a perspective view showing a system in accordance with the invention.
Figure 2:
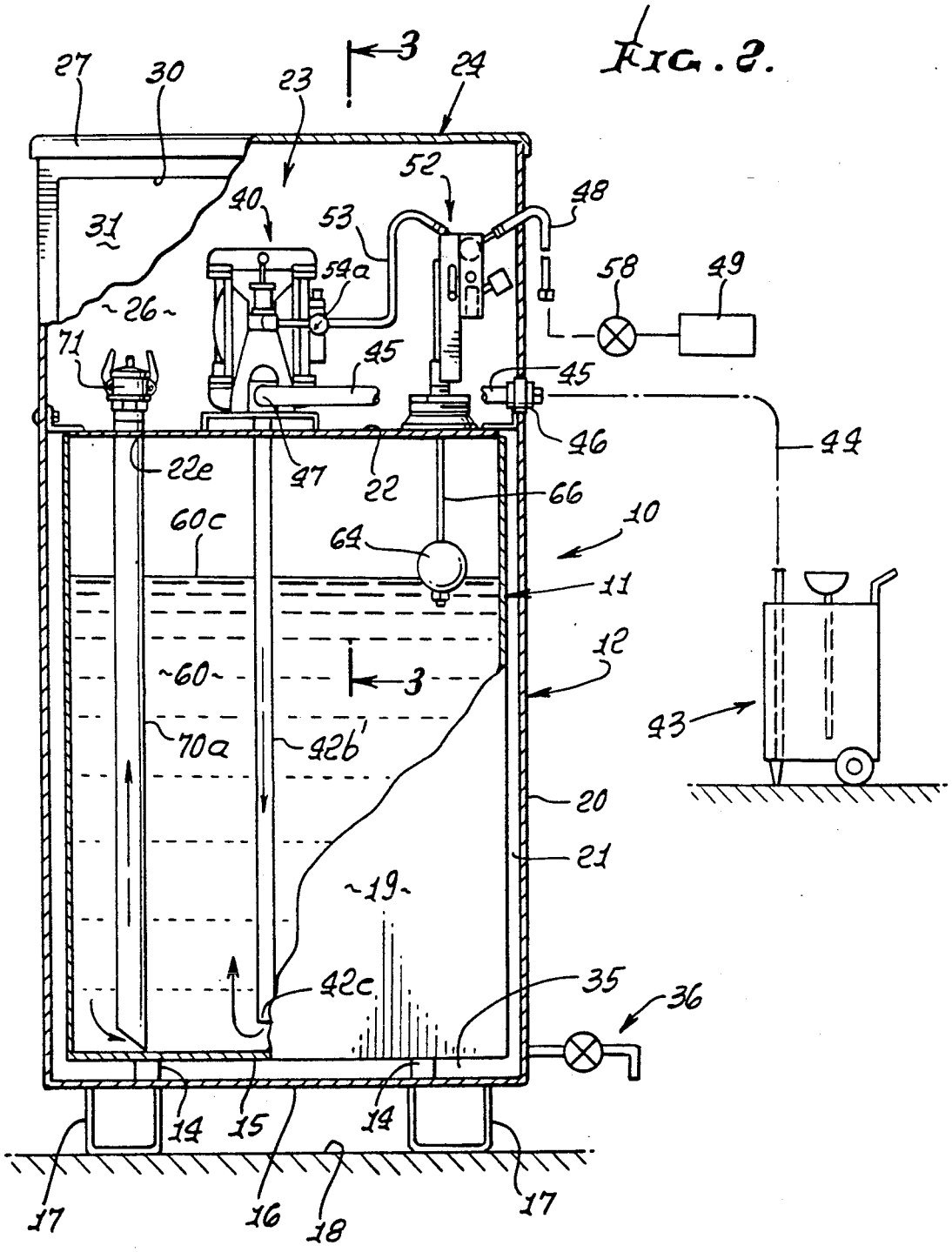
FIG. 2 is a section taken in elevation through the system of FIG. 1 to show interior construction.
Figure 3:
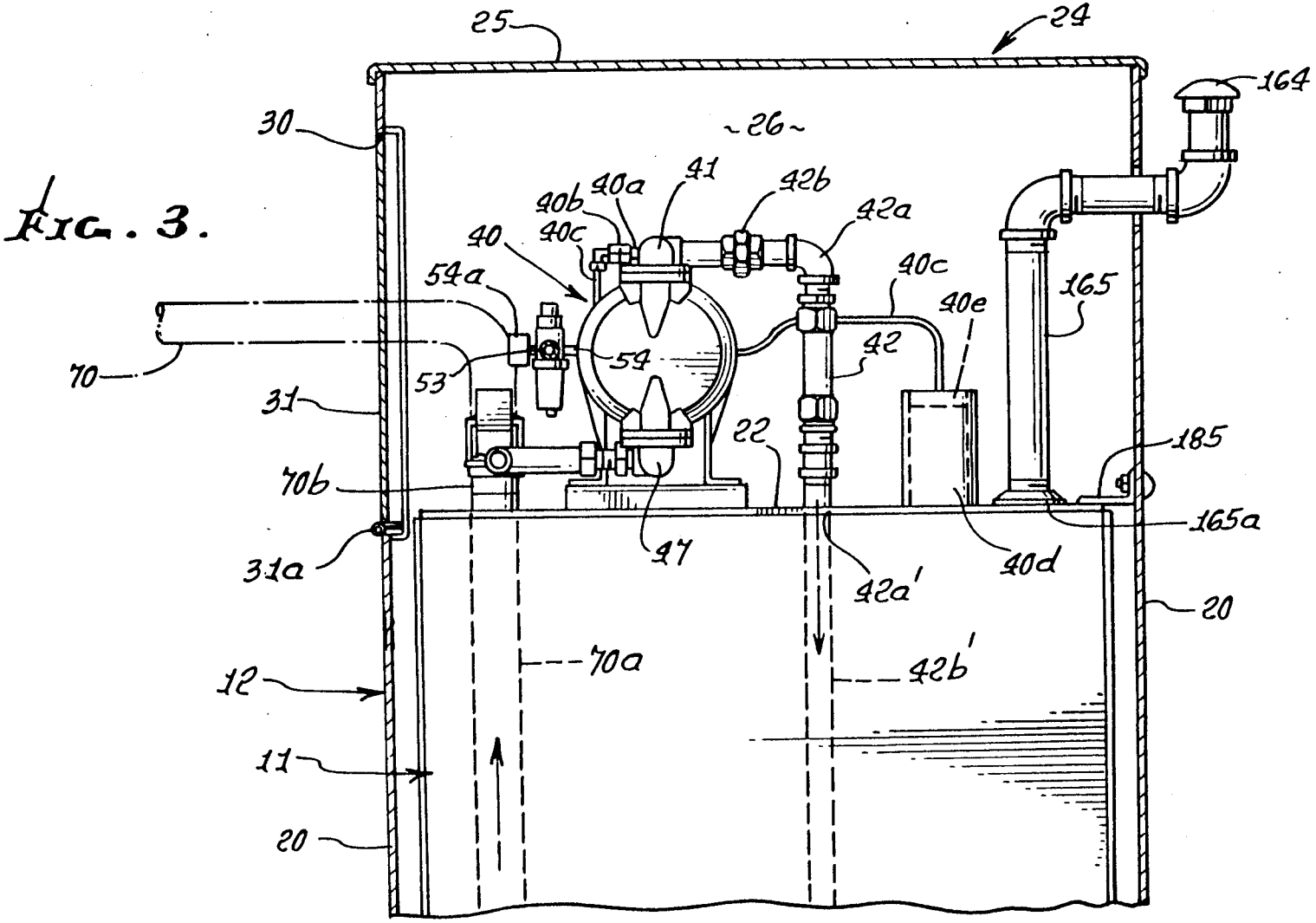
FIG. 3 is an enlarged section taken in elevation of lines 3—3 of FIG. 2.

In FIGS. 1-3, the safety tank apparatus 10 includes an inner metallic tank 11, which is closed, and an outer metallic tank 12 protectively receiving the inner tank. The outer tank is upwardly open and has a removable top or cover 24 so that the inner tank may be lowered downwardly into the inner tank to be supported by spacers 14 located between the bottom wall 15 of tank 11 and the bottom wall 16 of tank 12. Likewise, feet or spacers 17 support the bottom wall 16 on the ground or pavement 18. Feet 17 are channel shaped to receive the tines of lift trucks or the like. Also, the feet allow visual inspection of the bottom of the outer tank and attachment to pavement 18.

The inner tank has a side wall or walls 19 which extend upright in inwardly closely spaced relation from the side wall or walls 20 of the outer tank. While various tank configurations are possible, each tank preferably has four walls, whereby inner tank 11 has maximum capacity. See space 21 between walls 11 and 20 in FIG. 5. All tank walls are typically metallic (thin steel sheet, for example) and walls 19 and 20 extend upright. The inner tank is closed by a metallic top wall 22, generally near but below the level of lower hinge 31*a* of a closure 31 for a side opening 30 in an upright wall of the outer tank, for lateral accessibility of controls mounted on that top wall 22, as will appear. Such controls are generally designated at 23. Note brackets 185 connecting walls 20 to top wall 22 to position the inner tank in the outer tank.

Cover 24 extends over the inner and outer tanks 10 and 11 to protect the controls 23 and secondary containment spaces 21 and 35. That cover 24 has a top wall 25 spaced above inner tank top wall 22 (see space or interior 26), and side wall or walls indicated at 27. The latter are removably attached to the outer tank side walls, as at 27*a*, rigidizing the overall assembly. Cover 24 may be square in outline, as shown.

As referred to, the closure 31 (lockable at 31*c*) is hinge attached to the outer tank front wall to be movable, i.e, openable for example on hinge or hinges 31*a*, to expose the space or interior 26 of the cover, thereby providing direct access to the controls, without having to lift or raise the top cover 24. Also, opening of the closure allows downward visual inspection of spaces 21 and 35. At the same time, the cover always provides protection for the controls, as against adverse weather, vandalism, impacts, etc. Also, with the closure 31 normally closed, outside air (i.e., oxygen) is sufficiently excluded from access to the interior 26, for minimizing risk of fire at the controls, and to exclude access of exterior flames to the controls and to the inner tank. Some air circulation is provided by louvered vents at 198.

The controls or control means 23 are so located, due to the construction and interfitting of the tanks 11 and 12 and the cover 24, as to provide direct lateral access to the controls via the opening 30, when the closure 31 is open. As shown, the controls are carried on the top wall 22 of the inner tanks so tat any liquid spillage will drain downwardly into the narrow space between the tanks 11 and 12, to the bottom spaces 21 and 35. Liquid leaking to or otherwise collecting in spaces 21 or 35 may be removed as by a suction line.

Figure 4:
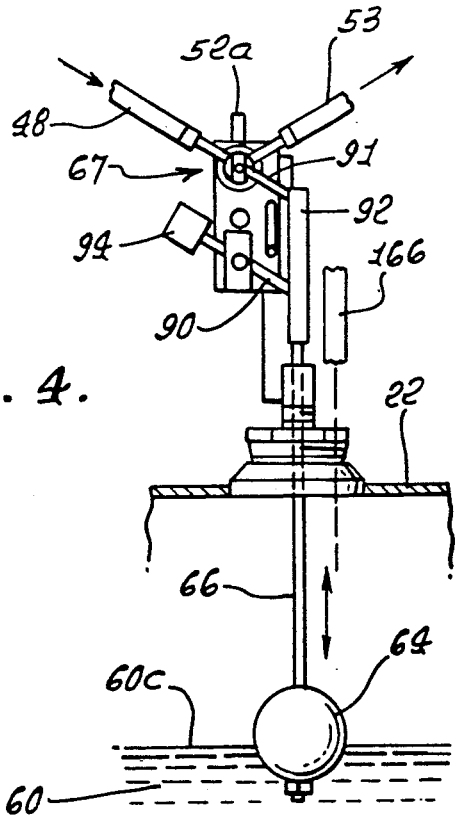
FIG. 4 is a schematic view of an air (pneumatic fluid) valve control mechanism.

Referring to FIGS. 3 and 4, the control means is shown to include a pump and pump motor unit 40, the pump having an intake port 47 for in-flowing waste liquid, and a discharge port 41 for the liquid. Unit 40 may be of double diaphragm, reciprocating type. Port 41 is connected via permanent line 42 and fitting 42*a* and 42*b* with a pipe or duct 42*b* extending vertically from a port 42*a* in top wall 22 downwardly to a discharge point 42*c* near bottom wall 15, whereby waste liquid pumped into the tank system is delivered into the inner tank. See also line or duct 44 extending from a waste liquid collection unit or caddy 43 (as used at oil-change stations) to the pump intake line 45 in space 26. Line 45 extends from a connection at 46 to wall 20 via knockout 20*a* to the pump intake port 47. Duct 44 may be attached endwise to line 45 at the connection 46.

Likewise, a line 48 from a source 49 of pressurized air passes through upright wall 20 via knockout 20*b* and leads to a valve 52 near the pump. The valve is in turn connected at hose 53 to the pump motor air intake regulator 54*a*, which is in turn connected to pump motor air intake port 54. Thus, the pump may be air motor driven, for safety. Exhaust air is vented to space 26. An air supply control valve appears at 58 to control operation of the motor. Overflow liquid from the pump passes via port 40*a*, fitting 40*b*, and through line 40*c* and through a cap 40*e* of emergency relief vent 40*d* to drain into the inner tank. If excess pressure builds up in the inner tank, it is released by blow off of cap 40*e*.

Valve control means is provided for sensing the level of liquid in the inner tank, and for automatically closing the valve 52 in response to rising of the top level 60*c* of waste liquid 60 in the inner tank to a predetermined level, as for example to about 95% of full level in the inner tank. Also, the valve bypasses incoming air to a relief port 52*a* providing an audible alarm to indicate that level 60*c* has reached the predetermined level. Such control means is shown in FIG. 4 to include a float 64 in the inner tank, and floating in or on the waste liquid. A stem 66 connects the float to a rotating disc-type stopper at location 67 in the valve, to seat or close the stopper when 95% level is reached, thereby shutting off compressed air supply to the pump motor. Note parallelogram linkage arms 90 and 91 slidably connected with vertical link 92, attached to stem 66. Also note counterweight 94.

Liquid may be removed from the filled tank by unlocking and opening the access door 31, and by connecting a removal line 70 to a stand-pipe 70*a* in tank 11, and via a top opening 22*e* in wall 22, and a connection at 70*b*, pipe 70*a* normally closed by a cap 71 in space 26. Line 70 may be extended through the opening 30 in the outer tank side wall 20 when the closure 31 is opened. See FIG. 3. Other openings, with appropriate plugs, may be provided in top wall 22, as for example normal and emergency vents, to vent air and fumes from the upper tank as it is filled with liquid, etc. See vent pipe 165 and opening 165*a* to the inner tank. Pipe 165 passes through the opening provided by knockout 20*c*.

As note, the system does not require any electricity, all components being mechanical.

Site level gauge 166 may be located next to the air shut-off valve, to indicate the remaining fill capacity of the inner storage tank. It is viewed via port or window 169 in closure 31. Port 169 has a covering of clear material, such as plexiglass, to provide for visual inspection of level gauge 166 without opening closure 31, and to keep weather and excess air out of spaces 21, 35 and 26.

When transferring liquid to the storage tank, the operator first looks at the site gauge to determine the existing fill capacity of the tank to see if transfer is possible, or if pick-up is needed. Second, the suction hose 44 is coupled to the collection caddy 43 and the air source is turned on, as by opening valve 58. When the collection caddy is emptied, the hose 44 is disconnected, and then the air is turned off at valve 58.

If the automatic shut-off valve 52 closes during transfer of liquids into the storage tank 11, the predetermined maximum fill level has been reached. The valve 52 will bypass air from 40 to an audible air alarm 52*a* which can be located inside the enclosure or remotely. The pump motor will then remain inoperable until the liquid in the tank has been lowered below the maximum fill level.

If at any time the site gauge 166 indicates the liquid level is near maximum fill capacity, or the automatic shut-off valve engages, the operator should contact a waste oil hauler to schedule a pick up.

When emptying the inner storage tank, the first step is to unlock the environmental closure 31 (normally locked at 31*c*) and open it so that the control assembly area is accessible. Second, a visual inspection of spaces 21, 35, and 26 should be conducted. Third, suction hose 70 from the truck should be connected to the coupler at the top of pipe 70*a* after removing the cap 71 on the coupler. Fourth, when disconnecting the suction hose, the suction should remain "on" so the liquid remaining in the hose empties completely into the removal truck. Fifth, place the cap back on at 71, and conduct another visual inspection of spaces 21, 35 and 26. Sixth, the environmental closure 31 should be closed (or lifted) back into place and locked.

Space 26 is vented at openings 198 in side wall 20.

Drainage of inadvertently spilled liquid in space 26 can occur off top wall 22 into spaces 21 and 35, as referred to, for safety.

Figure 5:
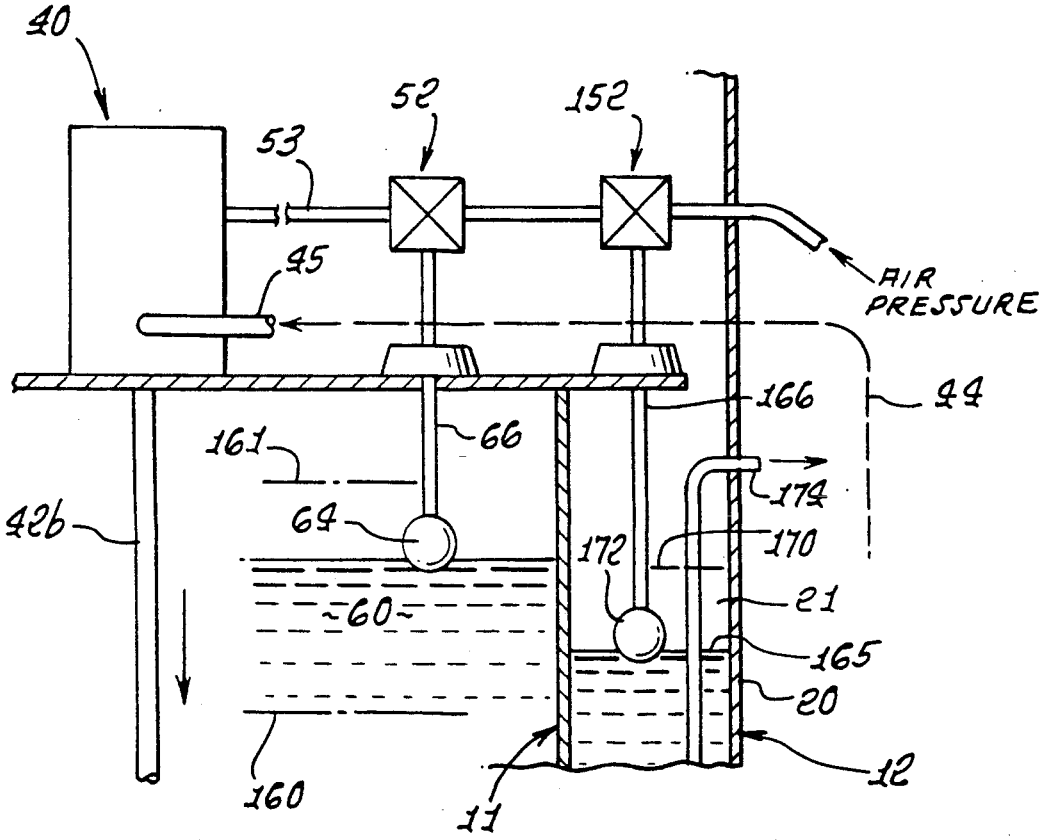
FIG. 5 is a schematic showing of automatic means to control inflow of liquid to the inner tank.

In FIG. 5, elements the same as in FIGS. 2 and 4 bear the same numerals. Control means is provided for automatically effecting flow of liquid (hydrocarbon, for example) as via line 45 and pump 40, into the inner tank, from the exterior of the safety apparatus if the level of liquid in the inner tank drops below a predetermined level (see level 160); the control means also prevents flow of each liquid into the inner tank if the level of liquid rises to or above a predetermined upper level (see level 161). Such control means includes, for example, a valve 52 via which pressurized motive fluid (air, for example) flows via line 53 to the pump 40 operating to pump liquid via lines 45 and 42*b* into the inner tank, and a first float 64 for sensing the actual surface level of the liquid 60 in the inner tank. If the liquid level rises to 161, the float is elevated to a position to close valve 52, and if the level drops to 160, the float is lowered to a position to open valve 52. Other equivalent means may be employed.

Also provided is other control means for automatically preventing inflow of liquid into the inner tank if the level 165 of liquid in space 21 is above a predetermined level, as at 170. This provides an additional safety feature in that, if the inner tank leaks to space 21, and sufficient liquid flows into that space, no further liquid will be passed into the inner tank. Note for example that such other control means may include a valve 152, like valve 52, and in series therewith via motive air pressure line 153. If the level of leaked fluid in space 21 rises to 170, the float 172 in space 21 also rises, causing a link 166 to close the valve 152, stopping the pump 40. Liquid in space 21 may then be sucked or pumped out, as at 174; and the float 172 then drops to open valve 152 and allow resumption of operation of pump. Equivalent structure may be provided.

Accordingly, in the example shown, the pump is controlled by automatic operation of either of the valves 52 or 152 by means of sensors sensing liquid levels in inner tank, and in the safety space 21 surrounding the inner tank.

Figure 7:
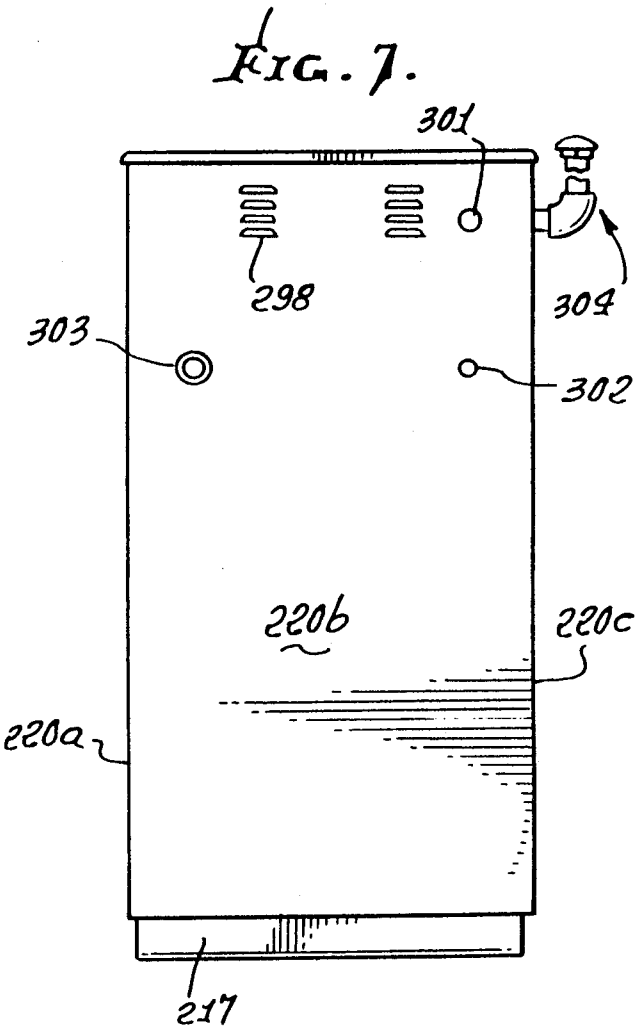
FIG. 7 is an end elevation taken on lines 7—7 of FIG. 6.
Figure 6:
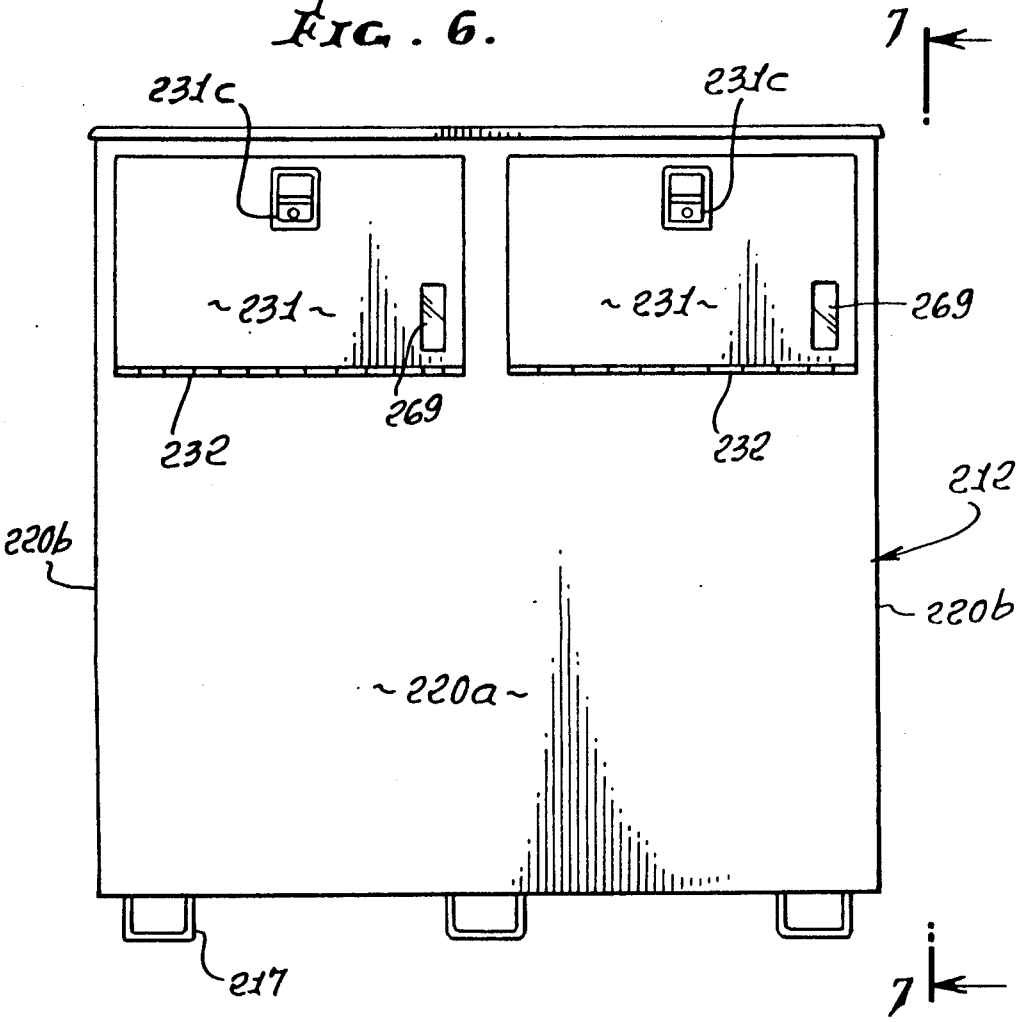
FIG. 6 is a front elevation of a modified multi-tank unit.
Figure 8:
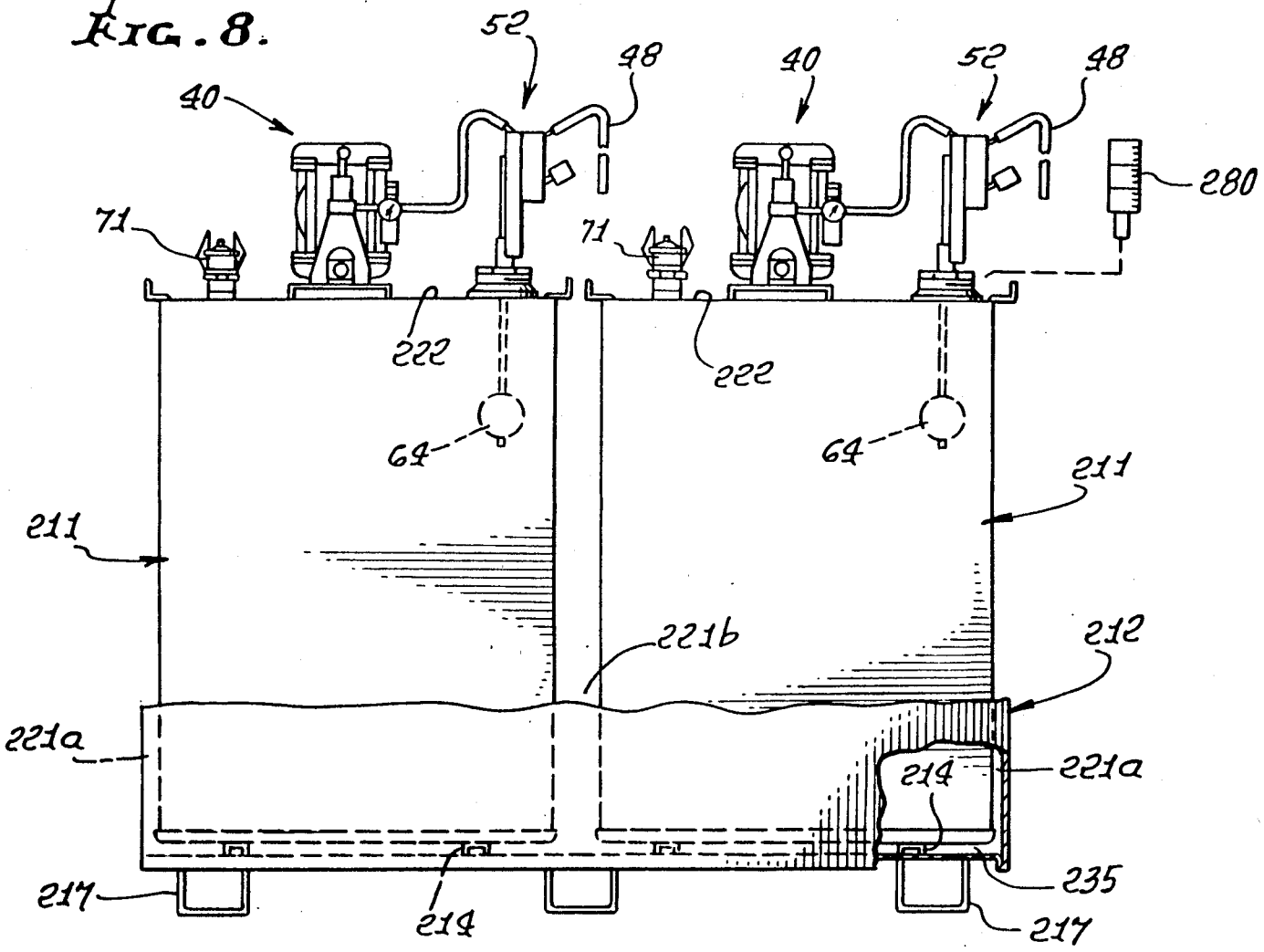
FIG. 8 is a front elevation showing interior construction of the FIG. 6 unit.
Figure 9:
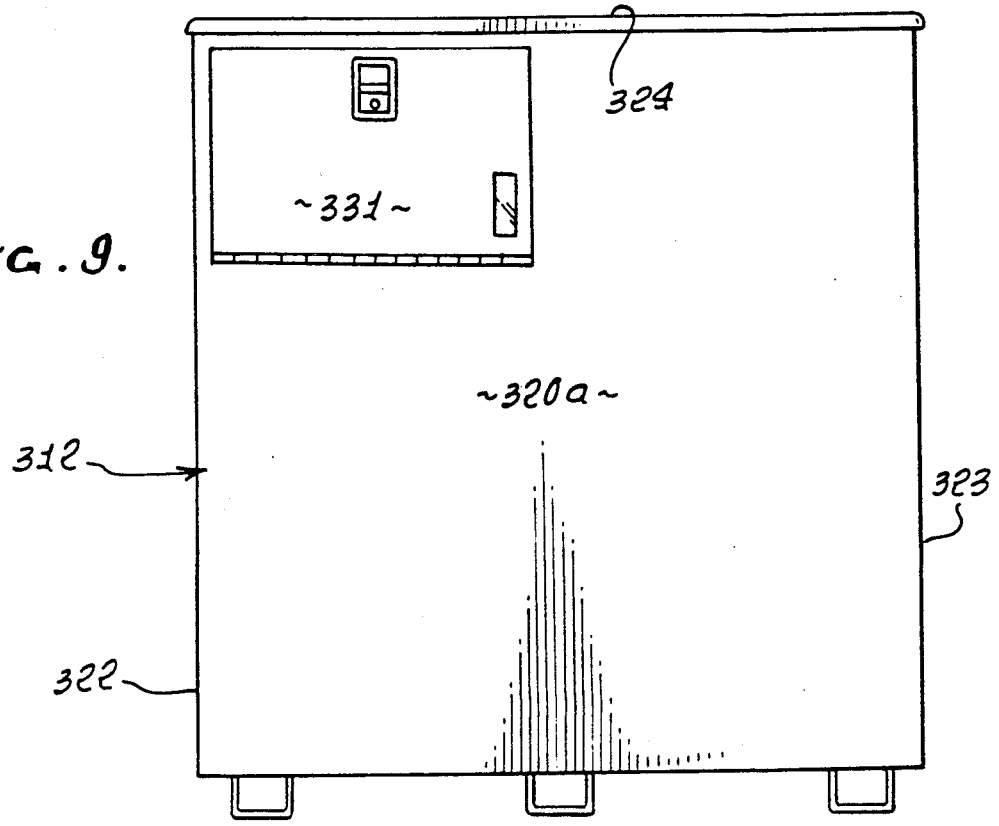
FIG. 9 is a front elevation of another modified multi-tank unit.
Figure 10:
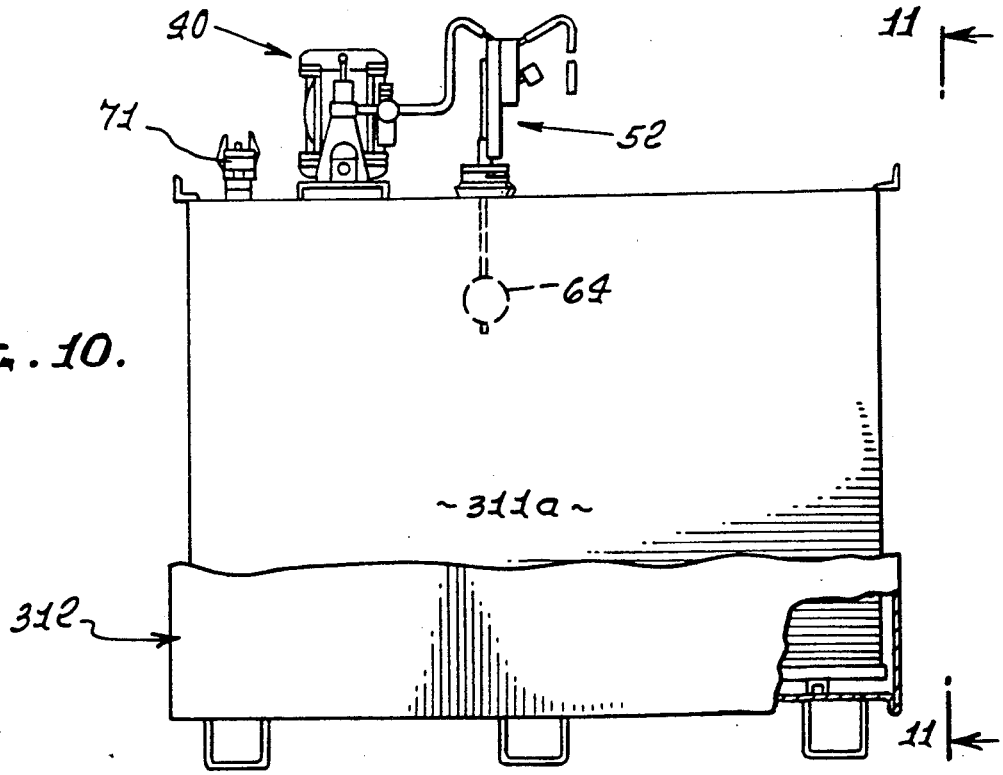
FIG. 10 is a front elevation showing interior construction of the FIG. 9 unit.
Figure 12:
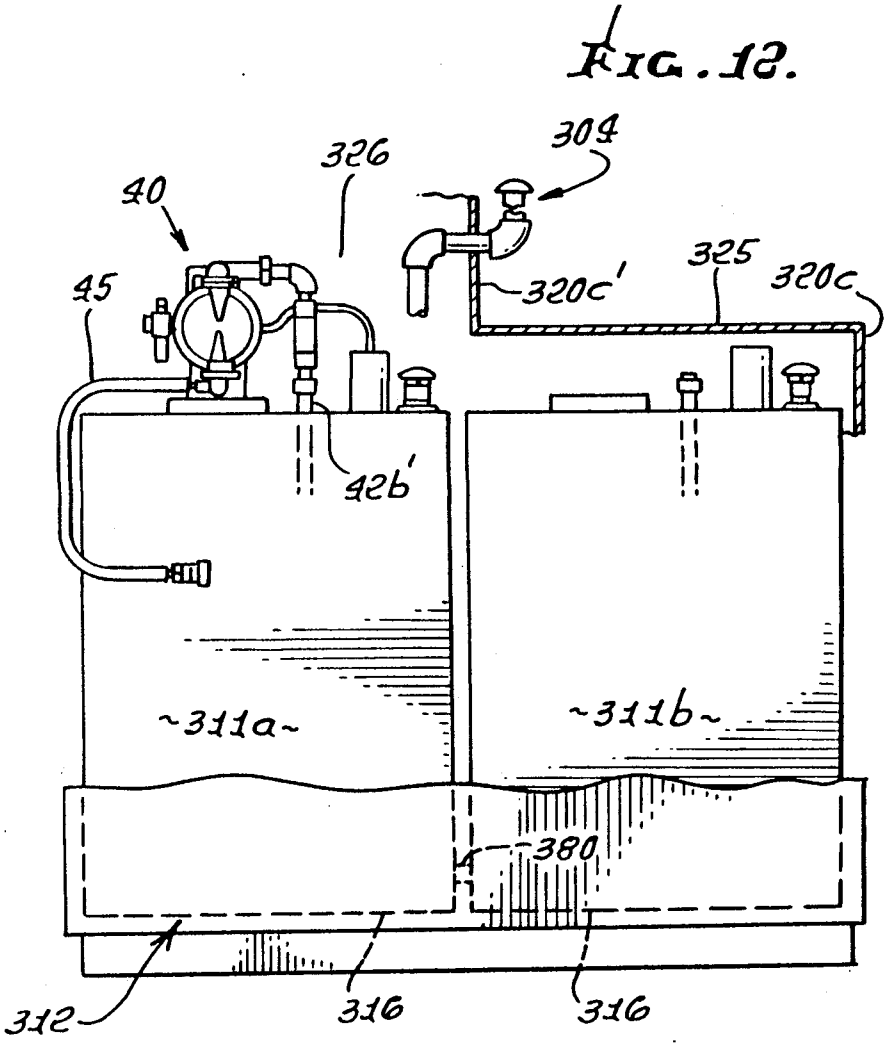
FIG. 12 is a side elevation showing the interior construction of the FIG. 9-11 unit.
Figure 11:
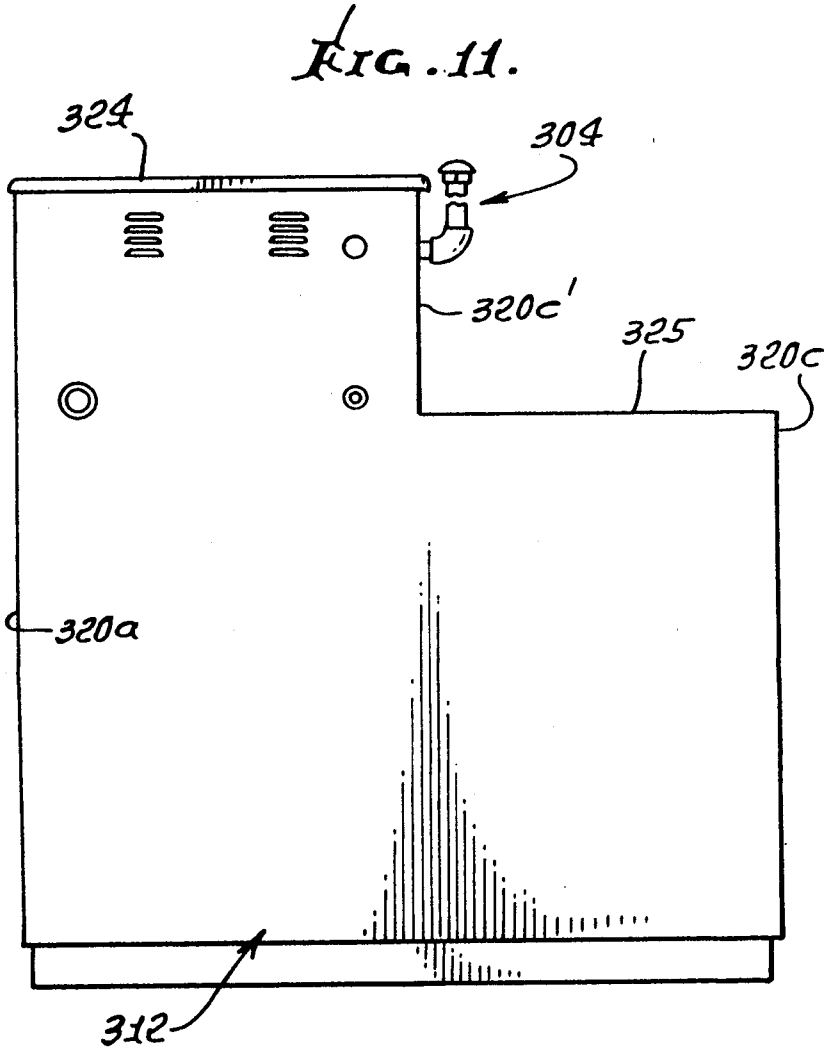
FIG. 11 is an end elevation taken on lines 11—11 of FIG. 10.
Figure 14:
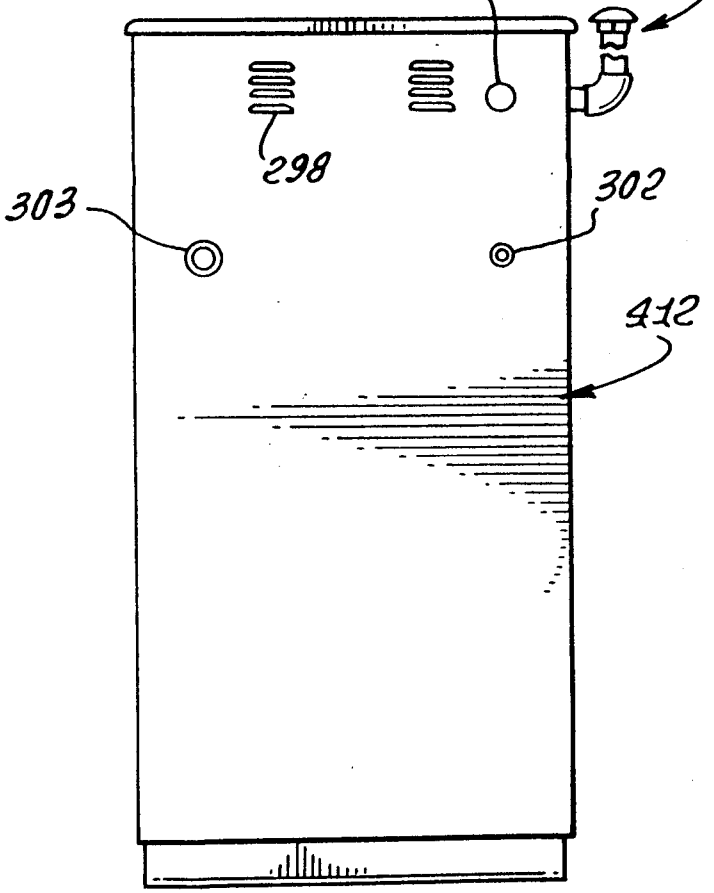
FIG. 14 is an end elevation taken on lines 14—14 of FIG. 13.
Figure 13:
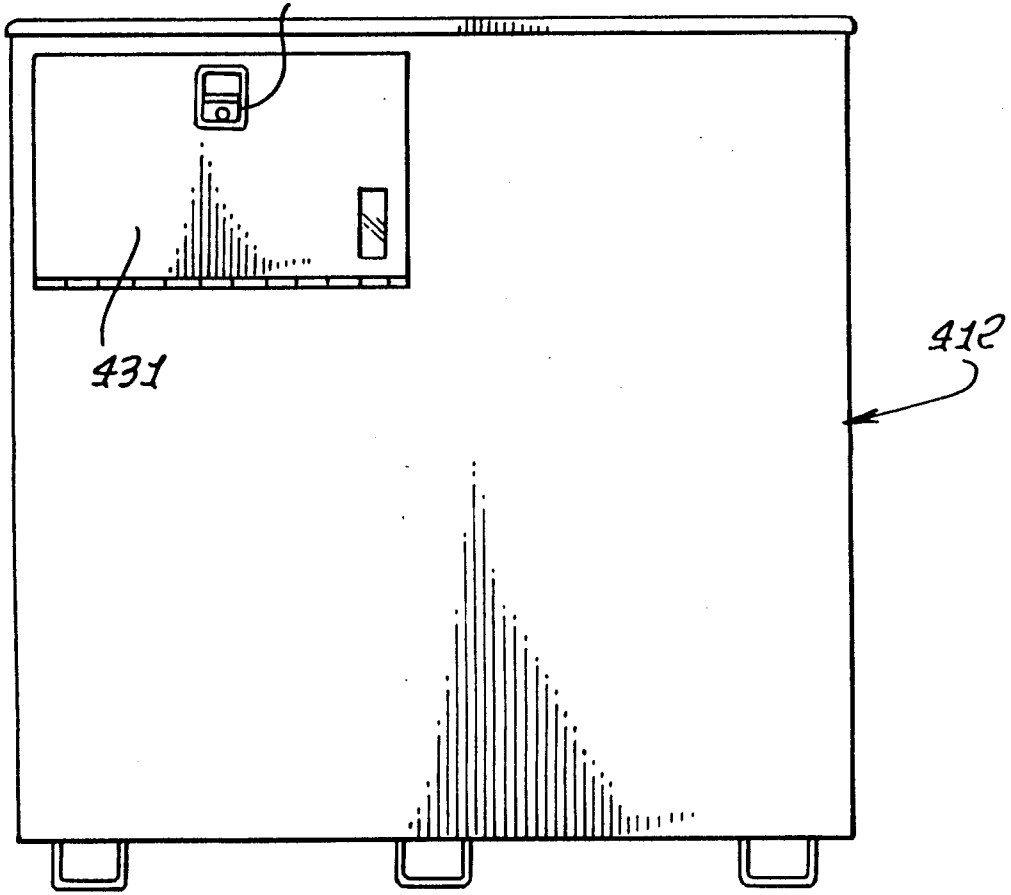
FIG. 13 is a front elevation of yet another modified tank construction.
Figure 16:
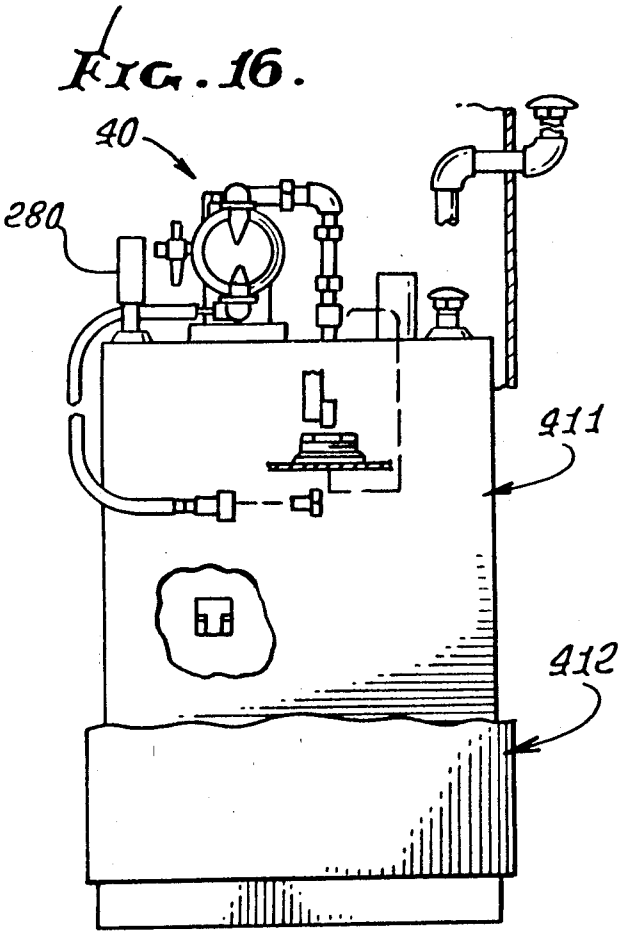
FIG. 16 is an end elevation on lines 16—16 of FIG. 15.
Figure 15:
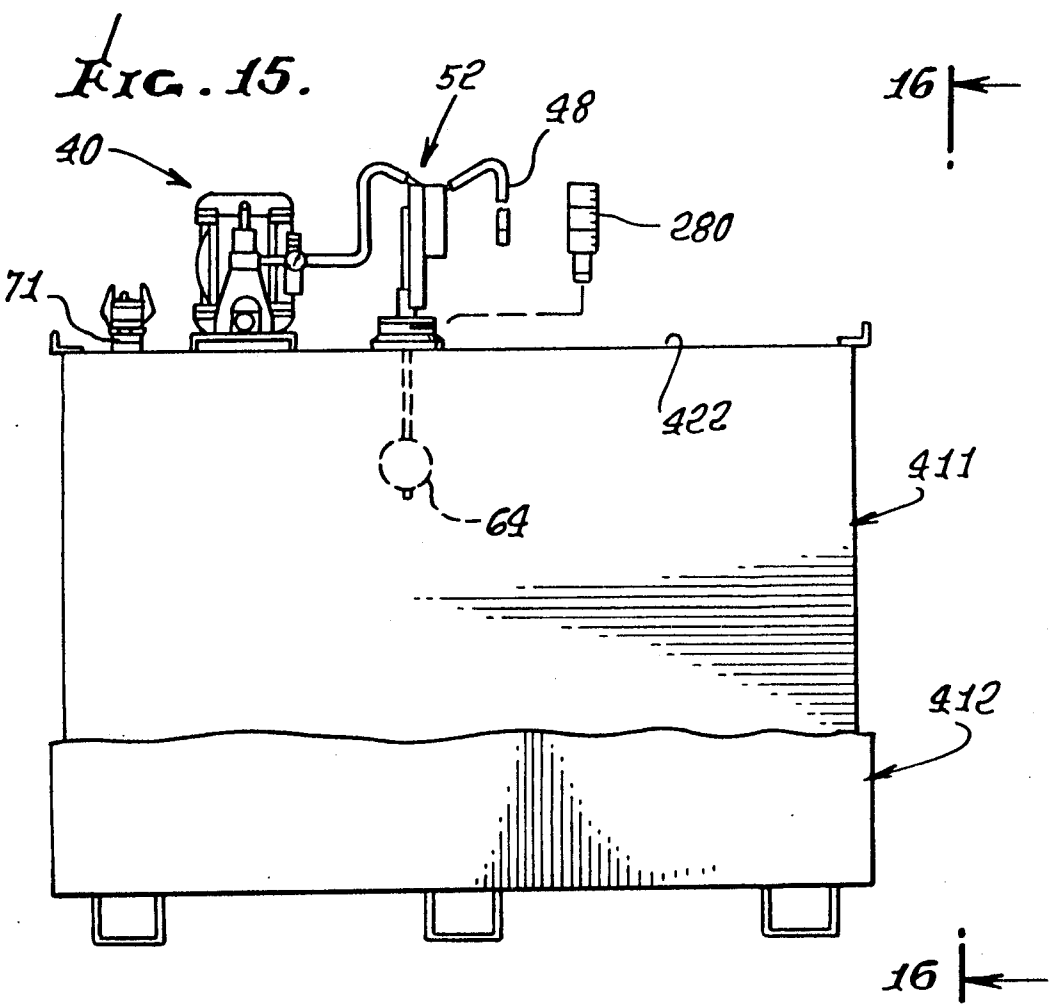
FIG. 15 is a front elevation of the FIG. 13 unit, broken away to show interior construction.

FIGS. 6–8 show a multiple tank assembly in a single unit. The outer tank 212 (corresponding to tank 12) is elongated to receive two like inner tanks 211, each of which corresponds to tank 11. Equipment is mounted on the top wall of each inner tank, and corresponds to the equipment discussed in FIGS. 1–5. The same identifying numerals are used to identify the item of such equipment.

The outer tank front wall panel 220*a* is of a length to accommodate the two inner tanks between outer tank end wall panels 220*b*, and also between front and back panels 220*a* and 220*c*. Two closures 231 (like closure 31) are hinge attached at 232 to the front wall to be movable, i.e., openable to expose the equipment mounted on the inner tank top walls 222. Note also the locks 231*c* for the closures, and the ports 269 in the closures via which oil level indicators 280 are visible. Note the spillage and leakage receiving spaces 221*a* between the inner tank upright walls, and the outer tank upright walls; the spillage space 221*b* between the two inner tanks, and the bottom space 235, corresponding to space 35. See also feet or spaces 214 and 217.

Associated with an outer tank end wall panel 220*b* are; louver vents 298, working vent (knock out) 301, air pressure line inlet (knock out) 302; and suction line inlet (knock out) 303. A working vent pipe elbow, with cap, is indicated at 304. Both inner tanks may be used to receive waste oil, as at vehicle filing stations, truck stops, and the like.

FIGS. 9–12 are like FIGS. 6–8 in that the outer tank 312 encloses or receives two like inner tanks 311*a* and 311*b*. The latter are spaced apart front-to-rear, relative to the front side or wall panel 320*a* of the outer tank. Accordingly, the two inner tanks have left to right length (see FIG. 10) about the same as, but slightly less than, the left-to-right length of the outer tank. The two inner tanks are in intercommunication, as via a duct or pipe 380 seen in FIG. 12, as located near the bottoms 316 of the two inner tanks. Accordingly, only one set of operating equipment is used, at the top of the inner front tank 311*a*. This is accessible via end closure 331, like one of the closures 231 referred to above. Two outer tank rear wall panels 320*c* and 320*c*' are provided, panel 320*c* located rearwardly of rear inner tank 311*b*, and panel 320*c*' located above the level of panel 320*a*, and forwardly thereof as an offset (in FIG. 11) to close the equipment space 326. See also outer tank side panels 322 and 323, and top walls 324 and 325.

Figure 17:
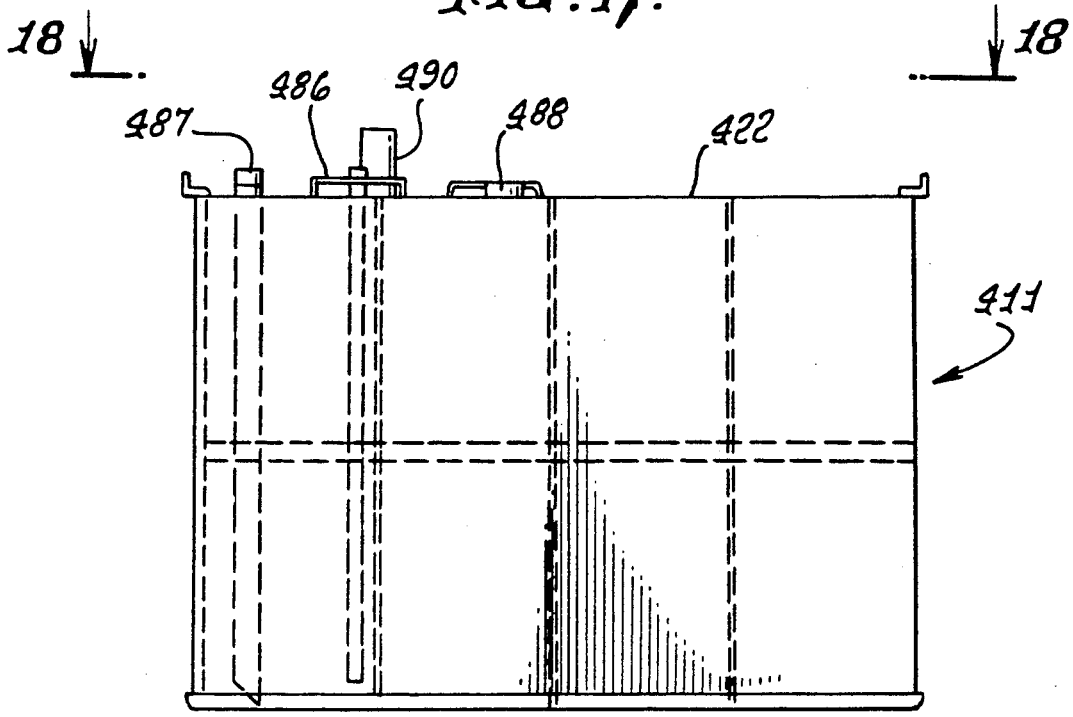
FIG. 17 is a font elevation, broken away, to show interior construction of the inner tank of the FIG. 13 unit.
Figure 18:
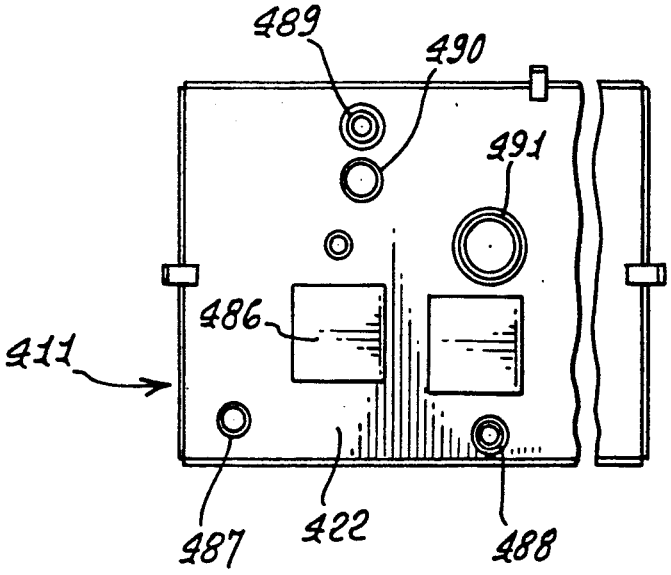
FIG. 18 is a top plan view taken on lines 18—18 of FIG. 17.

FIGS. 13–18 again show a sidewardly elongated outer tank 412, having a single closure 431 via which access is gained to a single equipment set, as in FIGS. 1–5. The latter equipment is mounted on top wall 422 of a single inner tank 411, which is also elongated, left to right, as is clear from FIGS. 15 and 17. FIG. 17 shows interior construction of the inner tank. Thus a single, enlarged, inner tank is provided. FIG. 18 shows the position of:

pump base 486 on wall 422.
suction line port 487 on wall 422
sight level port 488 on wall 422
working vent port 489, in 422
emergency evacuation vent port 490 in 422
shut-off valve mounting flange 491 on 422.

I claim:

1. In safety tank apparatus for installation to receive and store a liquid hydrocarbon or hydrocarbons, or the like, and from which the liquid may be withdrawn, the combination comprising:

a) tank structure including an inner metallic tank, and an outer metallic tank protectively receiving the inner tan, the outer tank having a side wall, there being upper interior space above the inner tank and within the tank structure, b) the tank structure including a cover extending over said interior space, c) an opening in said sidewall, and a closure closing said opening, the closure movable to expose said upper interior space to access from the exterior, d) and control means below said cover, and accessible through said opening for controlling flow of said liquid into the inner tank from the exterior of said safety apparatus, e) said closure extending above the level of liquid in the inner tank.

2. The combination of claim 1 wherein said tank structure includes a top wall over the interior of the inner tank, said control means located above said top wall.

3. The combination of claim 2 wherein said control means is supported on said top wall, in said upper interior space.

4. The combination of claim 3 wherein said inner tank has a side wall or walls supporting said top wall, the interior of the inner tank maintained out of open communication with space defined between the inner and outer tanks.

5. The combination of claim 2 wherein the inner and outer tanks define a vertically extending space therebetween, open to said upper interior space to receive drainage of liquid inadvertently spilled onto said top wall, during operation of said control means.

6. The combination of claim 1 wherein said closure has hinged interconnection to the outer tank side wall.

7. The combination of claim 1 wherein said control means includes a pump having an intake port and delivery port, the delivery port communicating with the interior of the inner tank, and a pneumatic drive connected with the pump and located within said upper interior space.

8. The combination of claim 7 including a valve for passing pneumatic fluid to the pump, and valve control means for sensing the level of liquid in the inner tank, and for closing the valve in response to rising of said level to a predetermined level.

9. The combination of claim 8 wherein said valve control means includes a float in said inner tank.

10. The combination of claim 8 wherein said inner tank has a top wall that supports said pump and valve to be directly accessible via said opening in said closure side wall.

11. The combination of claim 10 wherein said inner tank top wall has a first aperture, and a duct via which liquid in the tank may be removed, said duct extending below said closure top wall.

12. The combination of claim 11 wherein said inner tank top wall has a second aperture for venting air from the inner tank as liquid is filled into the inner tank by operation of the pump.

13. The combination of claim 8 including an audible alarm associated with said valve and operable in response to closing of the valve.

14. The combination of claim 1 wherein said outer tank has a side wall with an upper portion, and the closure has a lower position, said upper and lower portions having hinge interconnection.

15. The combination of claim 1 including a second combination of elements a)', b)', c)', and d)' corresponding to a), b), c), and d), both combinations of elements integrated into a single structure.

16. The combination of claim 15 including at least one additional tank attached to said single structure.

17. The combination of claim 16 including unused vehicle oil in said additional tank of tanks.

18. The combination of claim 15 including waste oil in the inner tank defined by a), and waste anti-freeze in the inner tank defined by a)'.

19. The combination of claim 1 wherein the outer tank has a side wall upper portion extending above the level of said control means, and there being knockout means in said side wall upper portion to enable communication between said upper interior space and the exterior.

20. The combination of claim 19 wherein said knockout means includes at least one of the following:

a knockout for a port to pass a vent pipe a knockout for a port to pass a line to a pump intake associated with said control means a knockout for a port to pass a pressurized line to a valve associated with said control means.

21. The combination of claim 1 including an indicator that indicates liquid level in the inner tank, and a view port in said locking closure to enable viewing of said indicator, said indicator located in said upper interior space.

* * * * *